US006032018A

United States Patent [19]

Matsumoto et al.

[11] Patent Number: 6,032,018

[45] Date of Patent: Feb. 29, 2000

[54] SHEET GUIDING MEMBER FOR GUIDING A SHEET HAVING A TONER IMAGE ON ITS SURFACE AND IMAGE FORMING APPARATUS

[75] Inventors: Hiroshi Matsumoto; Akitoshi Matsubara, both of Hachioji, Japan

[73] Assignee: Konica Corporation, Japan

[21] Appl. No.: 09/140,212

[22] Filed: Aug. 26, 1998

[30] Foreign Application Priority Data

Sep. 1, 1997 [JP] Japan ..... 9-235746

[51] Int. Cl.[7] ..... G03G 15/00

[52] U.S. Cl. ..... 399/397; 399/316

[58] Field of Search ..... 399/315, 316, 399/317, 397

[56] References Cited

U.S. PATENT DOCUMENTS

| | | | |
|---|---|---|---|
| 5,130,752 | 7/1992 | Marishita et al. | 399/315 |
| 5,552,873 | 9/1996 | Hirao et al. | 399/315 |
| 5,604,573 | 2/1997 | Endo et al. | 399/55 |
| 5,617,193 | 4/1997 | Ban et al. | 399/316 |

FOREIGN PATENT DOCUMENTS

| | | |
|---|---|---|
| 60-68366 | 4/1985 | Japan . |
| 1-60545 | 3/1989 | Japan . |
| 1304480 | 12/1989 | Japan . |
| 4301870 | 10/1992 | Japan . |
| 7-309477 | 11/1995 | Japan . |

*Primary Examiner*—Fred L. Braun
*Attorney, Agent, or Firm*—Jordan B. Bierman; Bierman, Muserlian and Lucas

[57] ABSTRACT

A sheet guiding member made of a conductive resin and having a surface resistance value of $1\times10_8$ Ω·cm to $1\times10_{13}$ Ω·cm. The material of which the guiding member is made includes a resin, a conductive material, and a bromine-containing organic compound. An image forming apparatus containing the aforementioned sheet guiding member is also described.

13 Claims, 3 Drawing Sheets

SHEET GUIDING MEMBER FOR GUIDING A SHEET HAVING A TONER IMAGE ON ITS SURFACE AND IMAGE FORMING APPARATUS

BACKGROUND OF THE INVENTION

The present invention relates of electrostatically transferring a toner image formed on a photoreceptor onto a recording sheet, specifically to a recording sheet guiding member used for an image forming apparatus such as a copying machine, a printer and a facsimile in which an electrophotographic method is applied and an image forming apparatus having aforesaid recording sheet guiding member.

Heretofore, as an image forming apparatus, a copying machine, a printer and a facsimile to which the electrophotographic method is applied are applied. Specifically, a constitution in which a visible image is formed by a process including a step to electrostatically transfer a toner image formed on a photoreceptor onto a recording sheet is widely used.

Practically, in an image forming apparatus to which the electrophotographic method is applied, the surface of the photoreceptor is charged by means of a charger. Using image exposure, an electrostatic latent image is formed. Aforesaid latent image is developed by a developer composed of toner for forming toner image. Under a status in which a recording sheet composed of paper is brought into contact with aforesaid photoreceptor drum retaining toner image, due to corona discharging having an opposite polarity with toner in a corona discharger for transferring, the toner image is caused to be transferred onto the recording sheet electrostatically. Further, due to corona discharge by a corona discharger for separation, the recording sheet having the toner image is electrostatically separated. By fixing the toner image onto the recording sheet separated, the visible image is formed.

In an image forming apparatus provided with a corona discharger for transferring toner image or for separating recording sheet, it is necessary to locate a recording sheet guiding member for conveying the recording sheet along a prescribed conveyance path. Due to this, erroneous advancement of the recording sheet is prevented. For example, collision of aforesaid recording sheet to a corona discharger body, hindering a prescribed conveyance, is prevented.

Incidentally, a recording sheet guiding member used for an image forming apparatus is ordinarily formed by an electrical insulating resin. Therefore, aforesaid guiding member is subjected to friction charging due to oscillation of aforesaid recording sheet when guiding it. Aforesaid charging potential may reach the maximum kV. Due to this, disturbance may occur on the toner image retained electrostatically onto the recording sheet.

When the guiding member is charged due to friction with the recording sheet, the status of the friction charging of the guiding member, for example, the polarity and the size of the charging potential may become abnormal, due to the kind of aforesaid recording sheet, characteristics of toner, environmental conditions, conditions of corona discharge and other reasons. In such occasions, if the charging polarity of the guiding member has the same polarity as the toner, the toner on the recording sheet is repelled due to the effects so that aforesaid toner is split off from the recording sheet. As a result, a part of image to be formed is missed. On the other hand, if the charging polarity of the guiding member is opposite to that of the toner, the toner is absorbed from the vicinity of the recording sheet. As a result, image portions which should not be formed or contamination are formed.

In order to solve the above-mentioned problems, Japanese Tokkaihei 4-301870 proposes to use a resin which is subjected to friction charging to an opposite polarity as the toner.

However, due to aforesaid means, the guiding member is caused to be charged due to friction. Therefore, if the guiding member is charged to the same polarity as the toner, the transfer charge on the rear surface of the recording sheet is offset to be extinguished. Since the toner is drawn to the ambient portion thereof, the toner of aforesaid portion becomes so thin that white streak (image clearness) occurs. On the other hand, if the guiding member is charged to the opposite polarity of the toner, the transfer charge on the surface of the recording sheet becomes noticeable. Therefore, the toner is collected to cause black streak. Finally, the above-mentioned problems cannot necessarily be solved surely. In addition, the kind of the material usable as the recording sheet guiding member is restricted. Accordingly, those having sufficient properties cannot be obtained necessarily.

Japanese Tokkaihei 1-304480 discloses to provide a conductive material in the recording sheet guiding member or to provide a conductive layer.

However, in aforesaid means, under high humidity, corona charge on the surface of the recording sheet is leaked. Therefore, the toner moves to the ambient portion so that white,streak occurs. On the contrary, under low humidity, the toner is subjected to friction charging, occurring white streak or black streak. As a result, under high humidity and low humidity, it is impossible to obtain those causing white streak or black streak. There occurs a problem that sufficient environmental suitability and durability cannot be obtained necessarily.

As described above, conventional recording sheet guiding members may disturb a toner image retained electrostatically on a recording sheet charged due to friction with a recording sheet. In addition, sufficient environmental suitability and durability cannot be obtained.

SUMMARY OF THE INVENTION

The present invention was attained based on aforesaid circumstances. An object thereof is to provide a recording sheet guiding member used to an image forming apparatus which forms a visible image by a process including a step to electrostatically transfer a toner image formed on a photoreceptor onto a recording sheet, in which sufficient environmental suitability and durability can be obtained without disturbing a toner image retained on a recording sheet.

Another object thereof is to provide an image forming apparatus which forms a visible image by a process including a step to electrostatically transfer a toner image formed on a photoreceptor onto a recording sheet and which is provided with a recording sheet guiding member capable of obtaining sufficient environmental suitability and durability without disturbing a toner image retained on a recording sheet.

The recording sheet guiding member for the image forming apparatus of the present invention guides the rear side of the recording sheet which is conveyed in such a manner as to pass between a photoreceptor and a corona discharger and which has a toner image on the surface thereof in an image forming apparatus which has aforesaid photoreceptor and a corona discharger facing with it and which forms a visible image by a process including a step to electrostatically transfer a toner image formed on aforesaid photoreceptor onto a recording sheet, wherein aforesaid recording sheet guiding member is formed by a conductive resin composed of resins in which conductive agents and bromine-containing organic compounds are contained therein.

The image forming apparatus of the present invention forms visible images by means of a process including a step to electrostatically transfer toner images formed on a photoreceptor onto a recording sheet in which a photoreceptor, a corona discharger facing aforesaid photoreceptor and a recording sheet guiding member which guides the rear side of the recording sheet recording sheet, having a toner image on the surface thereof, which is conveyed in such a manner as to pass between the above-mentioned photoreceptor and the corona discharger, wherein the above-mentioned recording sheet guiding member is formed by a conductive resin composed of resins in which conductive agents and bromine-containing organic compounds are contained therein.

In the above, it is preferable that aforesaid conductive resin contains 0.1 to 10 weight parts of conductive agents composed of carbon black and 0.1 to 30 weight parts of bromine-containing organic compound in 100 weight parts of aforesaid resin.

Since the material of the recording sheet guiding member of the present invention is conductive agents and conductive resins composed of resins in which a bromine-containing organic compound is contained, aforesaid recording sheet guiding member has an effect to improve a sliding property (slidability) by reducing the friction coefficient due to its specific physical property. Therefore, when aforesaid recording sheet guiding member is oscillated with the recording sheet conveyed, it is difficult to be subjected to frictional charging. Moreover, even when it is subjected to frictional charging, its level is so low that the charging potential never be at a high status locally.

Accordingly, even when aforesaid recording sheet is conveyed in such a manner as that the rear surface of the recording sheet, which retains electrostatically un-fixed toner image on the surface thereof, is oscillated with aforesaid guiding member, there is no cause to create disturbance of aforesaid toner image. Moreover, such effect is surely provided regardless of any environmental conditions, and durability is obtained.

Since there is no specific limitation to the kind of resin, which is the main component of the conductive resin forming aforesaid recording sheet guiding member, an inexpensive resin can be used. Simultaneously with this, the manufacturing method thereof may be allowed to simply incorporate a conductive agent and a bromine-containing organic in the resin. Accordingly, aforesaid conductive resin can be manufactured by a method to simply knead them. Therefore, manufacturing is so easy that cost is low.

DETAILED DESCRIPTION OF THE PREFERRED EMBODIMENT

Figure 1:
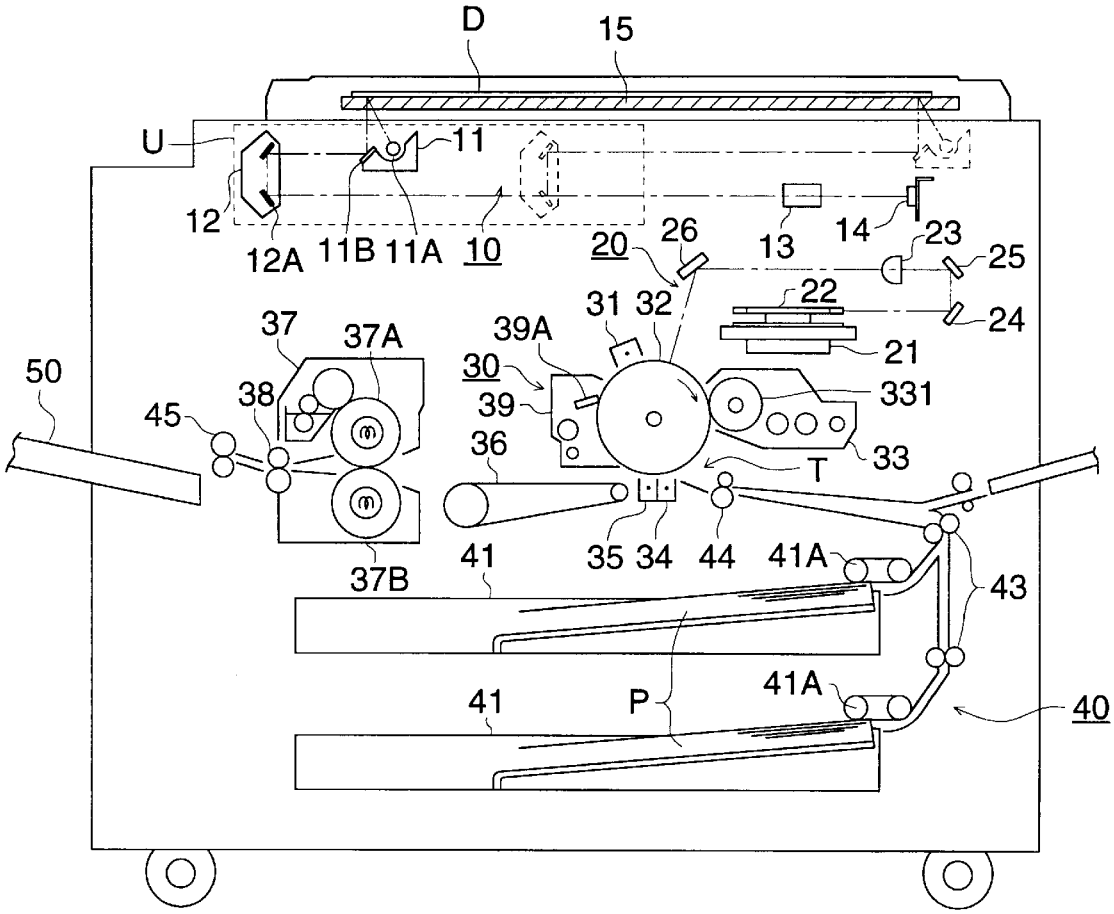
FIG. 1 is an explanatory view showing one example of an image forming apparatus in which an electrophotographic method is utilized.

FIG. 1 is an explanatory drawing showing a constitution of one example of an image forming apparatus utilizing an electrophotographic method. Numeral 10 represents an original illumination section. Numeral 20 represents an exposure section. Numeral 30 represents an image forming and processing section. Numeral 37 represents a fixing section. Numeral 40 represents a recording sheet feeding section. Numeral 50 represents a recording sheet discharging section.

In original illumination section 10, mark U represents an illumination unit. Aforesaid illumination unit U is composed of illumination light source section 11 composed of illumination lamp 11A and reflection mirror 11B and reflection section 12 composed of paired reflection mirror 12A. Aforesaid illumination unit U is movable along with the lower surface of original stand 15 on which original D is located. Numeral 13 represents a lens introducing light from reflection section 12. Numeral 14 represents a light receiving section, which is connected to a laser vibration section.

In exposure section 20, numeral 21 represents a laser control section, in which polygonal mirror 22 is provided. By means of polygonal mirror 22, laser beam is controlled in accordance with a beam signal entered to light receiving section 14. Aforesaid laser beam is irradiated onto photoreceptor drum 32 of image forming and processing section 30 through reflection mirrors 24 and 25, projection lens 23 and mirror 26.

In image forming and processing section 30, numeral 31 represents a discharger for charging provided upstream side compared with a laser beam illumination section. Numeral 33 represents a developing device provided downstream side compared with the laser beam illumination section, in which developing sleeve 33A is provided. "T" represents a transfer and separation section on the lowerstream side of developing device 33. Aforesaid transfer and separation section "T" is composed of transfer device 34 composed of a corona discharger and a separation device 35 composed of a corona discharger. In a region extended from aforesaid separation device 35 in the advancing direction of recording sheet, relay conveyance means 36 which conveys a recording sheet, retaining toner images on the surface thereof, separated from photoreceptor drum 32.

In a region extended from aforesaid relay conveyance means 36 in the advancing direction of recording sheet, fixing section 37 is provided. In fixing section, 37, heating and pressure rollers 37A and 37B each having a heater inside thereof and outlet roller 38 are provided.

Numeral 39 represents a cleaning means located on downstream side of transfer and separation section T, in which cleaning blade 39A which faces photoreceptor drum 32 is provided.

In recording sheet feeding section 40, two recording sheet trays 41 housing recording sheets having different dimensions each other are located vertically. In aforesaid recording sheet trays, accumulation of recording sheets P ordinarily composed of paper is set. Numeral 41A represent feeding rollers provided on recording sheet trays respectively 41. Numeral 43 represent conveyance rollers. Numeral 44 registration rollers provided on a position facing transfer and separation section T. Numeral 45 represent discharging rollers which discharge recording sheets from fixing section 37.

In the image forming apparatus having aforesaid constitution, photoreceptor drum 32 in image forming and processing section 30 is rotated in an arrowed direction. Following aforesaid rotation, photoreceptor drum 32 is charged by means of discharger 31 for charging. Next, corresponding to the light image of original obtained by original ilumination section, the laser beam from a laser vibration section (not illustrated)is projected and scanned under a status that it is controlled by polygonal mirror. Due to the above, electrostatic latent images are formed.

The electrostatic latent image on aforesaid photoreceptor is developed on developing section 33. Due to adhesion of toner electrostatically, toner image is formed. Next, the toner image is sent to transfer and separation section T. By this time, recording sheet P, sent from recording sheet feeding section 40 and kept in waiting status, is fed in such a manner that it synchronously contacts photoreceptor drum 32 by means of registration roller 44. Recording sheet P passes between photoreceptor drum 32 and transfer device 34 and separation device 35. When recording sheet P passes above transfer device 34, the toner image formed on photoreceptor drum 32 is electrostatically transferred onto the surface of the recording sheet, due to effects of the corona discharge thereof.

The recording sheet retaining the toner image as described above, then, advances to separation device 35. Due to corona discharge by the relevant separation device 35, charge on the rear surface of the recording sheet is removed due to effects by corona discharge. Due to this, aforesaid recording sheet is separated from photoreceptor drum 32, to which aforesaid recording sheet was electrostatically adsorbed. Aforesaid recording sheet is conveyed to fixing section 37 by means of relay conveyance means 36. After the toner image is heated to be fixed onto the recording sheet, aforesaid recording sheet is discharged to recording sheet discharging section 50 through discharging rollers 45.

Figure 2:
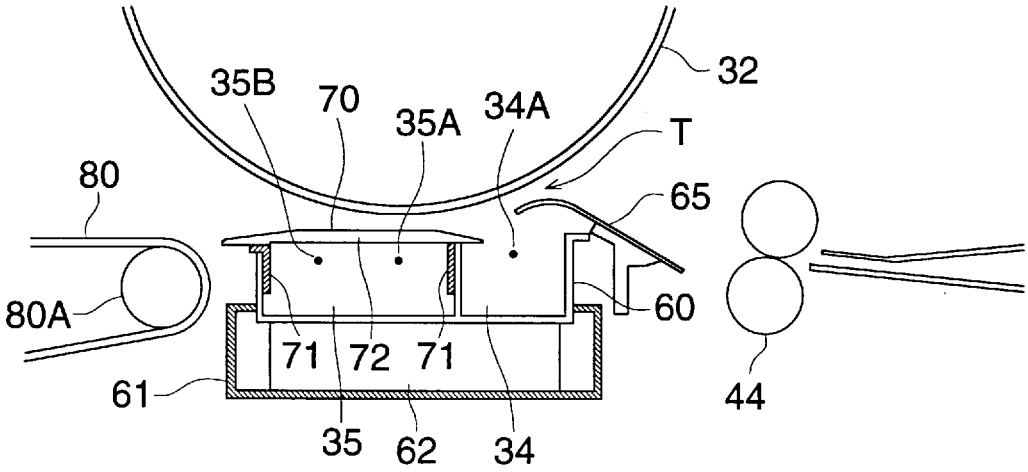
FIG. 2 is an explanatory view showing a constitution of a recording sheet separation section of an image forming and processing section in the image forming apparatus shown in FIG. 1.

FIG. 2 is a drawing showing magnified transfer and separation section T of image forming and processing section 30 in the image forming apparatus as described above. As shown in FIG. 2, in aforesaid transfer and separation section T, back plate 60 made of stainless steel is loaded slidably on guide rail 61 which extends in the shaft direction (hereinafter, simply referred to as "lateral direction") of photoreceptor drum 32 which is perpendicular to the advancing direction (in the FIG. 2, it represents left. Hereinafter, it is simply referred to as "advancing directions"). The cross sectional of aforesaid back plate 60, which has an aperture on the top portion. Aforesaid back plate 60 is a plate member which encloses the bottom surface, the front surface and the rear surface of a discharging wire. Aforesaid back plate 60 is supported by supporting member 62, in which the aperture at the top thereof faces the lower surface of photoreceptor drum 32.

In back plate 60, discharging wire 34A which constitutes transfer device 34 is retained in such a manner that aforesaid wire 34A extends in the lateral direction at a position facing the lower portion of photoreceptor drum 32. Simultaneously, discharging wires 35A and 35B for separation which constitute separation device 35 are retained at a position, in which they are located separately from discharging wire 34A for transferring.

Transfer device 34 is constituted of transfer wire 34A and back plate 60 which encloses aforesaid transfer wire 34A. On upstream of aforesaid transfer device 34, recording sheet advancing-guiding plate 65 which guides recording sheets from registration roller 44 is located. The leading end is extending in such a manner as to contact photoreceptor drum 32 close to the above of transfer wire 34A.

Separation device 35 is constituted of two separation wires 35A and 35B and back plate 60 which encloses aforesaid two separation wires 35A and 35B. Aforesaid separation device 35 is provided with separation section guiding member 70 composed of conductive resin material in such a manner as to be supported by aforesaid back plate 60.

Figure 3:
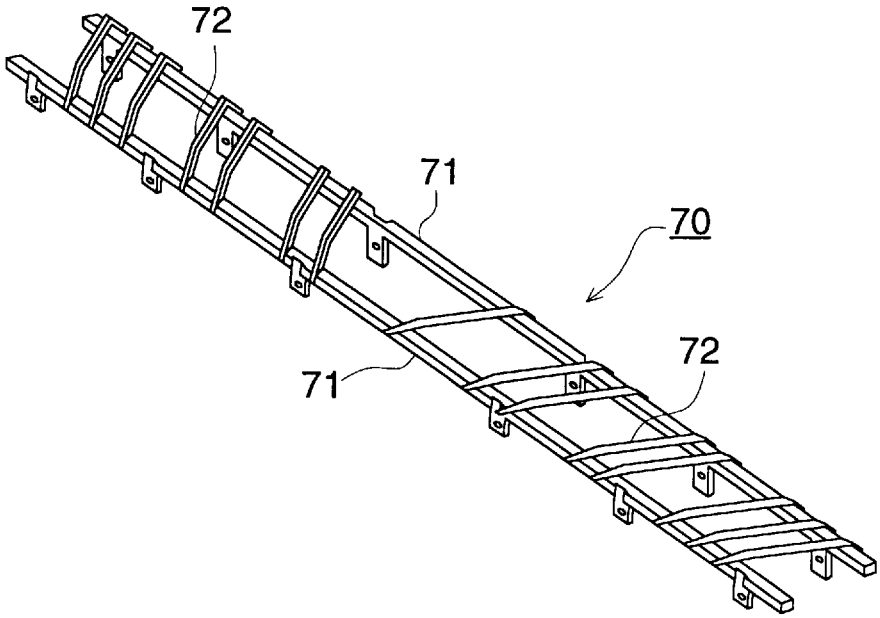
FIG. 3 is an explanatory perspective view showing the constitution of one example of the separation section guiding member.

As shown in FIG. 3, aforesaid separation section guiding member 70 extends in the lateral direction. Aforesaid separation section guiding member 70 is composed of beam portions 71 and 71, separated each other and running parallel, which are supported on the upper fringe portion of the front portion and the rear portion and plural rib-shaped guiding elements 72 which are integrally bridged between beam portions 71, in which the top fringe of each beam portion functions as a guiding fringe. The form of top fringe of guiding element 72, in illustrated separation section guiding member 70, viewing from the front side of FIG. 2 is a gentle trapezoid or mountain-shaped. Simultaneously, each guiding element is located obliquely, in which the leading end of each guiding element comes nearer to the center in terms of the lateral direction.

Figure 4:
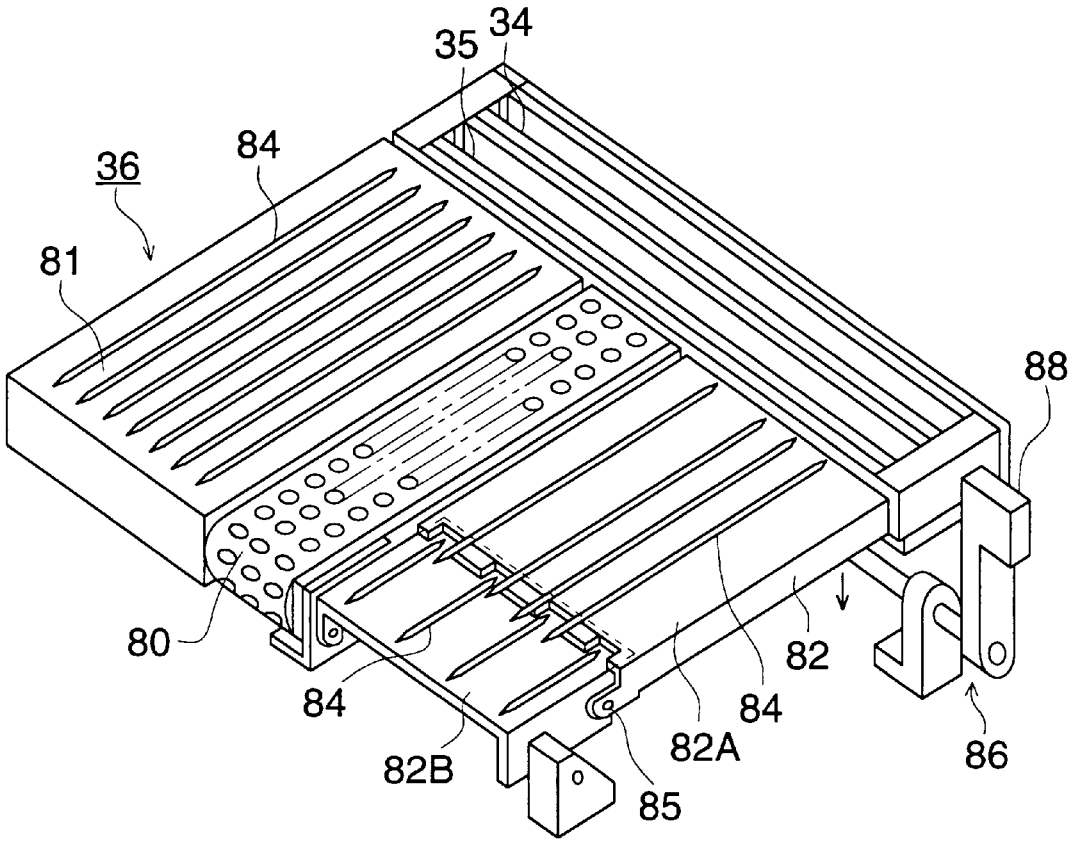
FIG. 4 is a perspective view showing the top side of a relay guiding member.

FIG. 4 is a perspective view looking from the top side of relay conveyance means 36, in which transfer device 34 and separation device 35 are shown in one Figure, while separation section guiding member 70 is omitted. This relay conveyance means 36 is located at the area extended from separation device 35 in the advancing direction. Aforesaid relay conveyance means 36 has a function to conveys a recording sheet, retaining toner images on the surface thereof, separated from photoreceptor drum 32 toward fixing section 37.

In illustrated relay conveyance means 36, at the central region in terms of the lateral direction, endless conveyance belt 80, which causes conveyance force by contacting the rear side (lower surface) of recording sheet which was separated from photoreceptor drum 32 and discharged thereto, crossed on paired rollers (which are represented as numeral 80A).

On both sides of aforesaid conveyance belt 80 in the lateral direction, relay guiding members composed of a conductive resin material are provided. Practically, first relay guiding member 81 is provided at the inner side (in FIG. 4, the left upper side) of conveyance belt 80 and second relay guiding member 82 is provided at the front side (in FIG. 4, the right lower side) of conveyance belt 80.

Both of first relay guiding member 81 and second relay guiding member 82 has an upper surface respectively whose height in the same level as the conveyance region of conveyance belt 80. On aforesaid upper surface, plural protrusions which extend in the advancing direction respectively are formed integrally.

In FIG. 4, first relay guiding member 81 forms a flat box. It is fixed to be provided. Second relay guiding member 82 is divided into two portions each of which is located in the advancing direction. The downstream end of upstream portion 82A is rotatably connected to the upstream end of downstream portion 82B, which is fixed, through shaft 85 which extends to the lateral direction. Due to this, aforesaid upstream end of upstream portion 82A rotatably falls downward. By means of switching lever 88 in switching and supporting mechanism 86, upstream portion 82A can be switched between an operational position whose height is approximately at the same level as the region for conveying recording sheet and unoperational position in which upstream portion 82A falls downward.

In the present invention, as a material for parts or all materials for transfer and separation section T in which recording sheets, which retain toner images electrostatically, receive corona discharge and guiding members, in Figures, the above-mentioned separation section guiding member 70 and relay guiding member (first relay guiding member 81 and second relay guiding member 82), located at the downstream region compared with transfer and separation section T, in which there is possibility that the rear surface of aforesaid recording sheet is oscillated, the following specific conductive resin materials are used.

The following conductive resin materials contain both of a conductive agent and a bromine-containing organic compound in a resin. As resins therefor, polypropylene, acrylonitrile-styrene-butadiene resin, polyacetal, polyphenyl sulfide, polycarbonate and insulating resins selected from otherwise. Among them, for separation section guiding member 70 specifically, those not deteriorating due to corona discharge are preferable. Due to this point and cost issue, polypropylene is preferable.

As a conductive agent contained in a resin, various agents can be used. Specifically, carbon black can preferably be used. It is preferable that content amount on 100 wt part of resin is 0.1–10 wt part and specifically 0.1–3.0 wt parts. If aforesaid content amount is too small, aforesaid resin is easily charged at low humidity. On the contrary, if the content amount is excessive, at high humidity, corona charge on the rear surface of the recording sheet is caused to be leaked, occurring black streak or white streak on images.

(1) Brominated phosphate type compounds

A. Tris(tribromoneopentyl)phosphate

B. Tris(dibromoneopentyl)phosphate

C. Tris(monobromoneopentyl)phosphate (2) Brominated bisphenol type compounds

D. TetrabromobisphenolA-bis(2,3-dibromopropyl)ether

E. TetrabromobisphenolS-bis(2,3-dibromopropyl)ether (3) Bis(brominated phenyl)alkane type compounds F. 1,1-bis(pentabromophenyl)methane G. 1,2-bis(pentabromophenyl) ethane H. 1,3-bis(pentabromophenyl)propane (4) Brominated cyanurate-containing compounds I. Tris(2,3-dibromopropyl)isocyanurate It is possible to use two or more kinds of the above-mentioned bromine-containing organic compounds, not only one kind.

The content of aforesaid bromine-containing organic compound on 100 wt parts is 0.1 to 30 wt parts. Specifically, 0.5 to 10.0 wt parts is preferable, and 1.0 to 5.0 wt parts. If aforesaid content is too small, improvement in slidability is little so that a recording sheet is easily subjected to friction charging, causing poor image. To the contrary, if aforesaid content is excessive, mechanical strength of the guiding member is reduced.

As described above, the guiding member, whose material is a conductive resin in which a bromine-containing organic compound is contained at a specific range on a resin, has a favorable slidability on recording sheets conveyed so that favorable conveyance property is obtained. Friction chargeability due to contact with a recording sheet is inhibited, in which that a conductive agent is contained gives additional effect. As a result, the occurrence of the disturbance on toner image can be minimized.

It is preferable to add antimony trioxide, as an assisting agent for improving slidability, to a conductive resin which forms the guiding member, in addition to a conductive agent and a bromine-containing organic compound. The content is ordinarily 0.1 to 30 wt parts on 100 wt parts of resin. Specifically, the content is preferably 0.5 to 10.0 wt parts.

The surface resistance value in terms of JIS K6911 of the guiding member composed of a specific conductive resin as described above is preferably $1\times10^{8}$–$1\times10^{13}$ Ω·cm and more preferably $1\times10^{9}$–$1\times10^{12}$ Ω·cm.

Due to aforesaid electrical features, friction charging of the guiding member under low humidity or high humidity can surely be inhibited so that the causes for the occurrence of the disturbance of toner image can be prevented. Namely, if the surface resistance value is excessive, the degree of friction charge cannot be inhibited with certainty. Accordingly, under low humidity specifically, there is a possibility that disturbance of toner image may occur. To the contrary, if the surface resistance is too small, charge on the rear surface of the recording sheet is leaked onto the guiding member. As a result, electrostatic retention force of the toner on the recording sheet is reduced. Therefore, there is a possibility to cause disturbance on the toner image under high humidity. Further, separation of the recording sheet becomes unsure.

With regard to the conductive resin in the guiding member, in the resin constituting it, it is possible to incorporate other additives in addition to the above-mentioned assisting agent for improving slidability, together with essential conductive agents and bromine-containing organic compounds.

Methods for preparing the above-mentioned conductive resins are not specifically restricted. Various methods can be used. Ordinarily, a conductive agent, a bromine-containing organic compound and other additives used as necessary are added to a resin. The mixture is heated to temperature not less than the softening point of aforesaid resin to be kneaded.

In order to prepare the guiding member of the present invention using the conductive resin, various methods can be utilized. Ordinarily, it is convenient to use various molding methods So far, the present invention was explained. However, form and location of the guiding member of the present invention can completely-freely be designed in accordance with practical constitution of the image forming and processing section in which aforesaid guiding member is integral. The guiding member has plural protrusion extending along the advancing direction of the recording sheets. It is preferable that the upper portion or the top of aforesaid protrusion contacts the rear surface of the recording sheet conveyed. Specifically, it is preferable that aforesaid forwards slightly obliquely compared with the advancing direction of the recording sheet.

As described above, in the guiding member of the present invention, corona discharge occurs by the separation device or the transfer device. The effects of the guiding member of the present invention are exhibited most suitably by being provided on the discharging effect region (transfer and separation section T in the illustrated example) in which the recording sheet retaining the toner image on the surface thereof electrostatically receives corona discharge and the relay region on the downstream side following aforesaid discharging effect.

Namely, the guiding member in aforesaid regions contacts the rear surface of the recording sheet. Even when the recording sheet passes the guiding member oscilably, the recording sheet is not noticeably subjected to friction charging, since aforesaid guiding member is formed by a conductive resin composed of a resin containing specific conductive agents and bromine-containing organic compounds. Therefore, provision of electro-static adverse influences on un-fixed toner image electro-statically retained on the surface of the recording sheet is avoided. As a result, it is possible to form favorable visible image in which there is no disturbance in toner image.

Even when the guiding member is not noticeably subjected to friction charging, if aforesaid guiding member is subjected to friction with the recording sheet, the recording sheet is unavoidably charged though it is slightly. It is preferable that the charging polarity thereof is the same as that of the toner of the toner image retained on the recording sheet. Accordingly, as the guiding member used in the image forming apparatus in which negatively charged toner is used, those whose friction charge polarity on the recording sheet is negative are preferable. For example, conductive resins using polypropylene are preferable.

EXAMPLE

Hereinafter, an example of the present invention will be explained. However, the present invention is not limited thereto.

Preparation of Conductive Resin

Polypropylene (100 wt parts), carbon black (0.3 wt parts), tris(tribromoneopentyl)phosphate (illustrated compound A (2 wt parts) as a bromine-containing organic compound and antimony trioxide (1 wt parts) were fused to be kneaded for preparing a conductive resin.

Preparation of Guiding Member

By molding the conductive resin obtained as above, the guiding member shown in FIG. 3 was prepared. This is referred to as Sample 1. The surface resistance value of aforesaid Sample 1 was $3\times10^{10}$ Ω·cm.

A guiding member was prepared in the same manner a in Sample 1 except that Illustrated compounds B through I were used in place of Illustrated compound A. Aforesaid compounds are defined to be Samples 2 through 9.

The surface resistance value of aforesaid samples were included in between $1\times10^{8}\times1\times10^{13}$ Ω·cm.

Each of samples 1 through 9 obtained as above was loaded to the separation device in the image forming apparatus employing an electrophotographic system, and image forming was repeated up to 50,000 times under the temperature of 20° C. and the relative humidity of 50 RH %. As a result, favorable copying image could be formed. None of them had disturbance or contamination on an visible image.

When preparing the conductive resin of the above-mentioned sample 1, 10 kinds of guiding members each having various surface resistance values were prepared, in which the content ratio of carbon black was modified. They are defined to be Samples A1 through A10. Each of aforesaid guiding member was loaded to image forming apparatus in the same manner as above. Under various environmental conditions in which temperature and humidity inside aforesaid image forming apparatus were modified, disturbance of visible image was investigated in the same manner as Sample 1 to 9. Table 1 shows the results thereof.

In Table 1, "A" represents that there is no disturbance in image, "B" represents that slight white spots or black streaks occurred. "C" represents that white spots or black streaks noticeably occurred. In addition, "low humidity" represents the temperature of 10° C. and the relative humidity of 20%. To the contrary, "high humidity" represents the temperature of 30° C. and the relative humidity of 80%.

TABLE 1

| Sample | A1 | A2 | A3 | A4 | A5 |
|---|---|---|---|---|---|
| Surface resistance value (Ω · cm) | $1\times10^{6}$ | $1\times10^{7}$ | $1\times10^{8}$ | $1\times10^{9}$ | $1\times10^{10}$ |
| Law humidity | A | A | A | A | A |
| High humidity | C | C | B | A | A |
| Sample | A6 | A7 | A8 | A9 | A10 |
| Surface resistance value (Ω · cm) | $1\times10^{11}$ | $1\times10^{12}$ | $1\times10^{13}$ | $1\times10^{14}$ | $1\times10^{15}$ |
| Law humidity | A | A | B | C | C |
| High humidity | A | A | A | A | A |

When preparing the conductive resin of the above-mentioned sample 1, 10 kinds of guiding members each having various surface resistance values were prepared, in which the content ratio of carbon black was modified while neither bromine-containing organic compound nor antimony trioxide were contained. They are defined to be Samples B1 through B10. Each of aforesaid guiding member was loaded to image forming apparatus in the same manner as above. Under various environmental conditions in which temperature and humidity inside aforesaid image forming apparatus were modified, disturbance of visible image was investigated. Table 2 shows the results thereof.

TABLE 2

| Sample | B1 | B2 | B3 | B4 | B5 |
|---|---|---|---|---|---|
| Surface resistance value (Ω · cm) | $1\times10^{6}$ | $1\times10^{7}$ | $1\times10^{8}$ | $1\times10^{9}$ | $1\times10^{10}$ |
| low humidity | A | A | A | A | B |
| High humidity | C | C | C | C | C |
| Sample | B6 | B7 | B8 | B9 | B10 |
| Surface resistance value (Ω · cm) | $1\times10^{11}$ | $1\times10^{12}$ | $1\times10^{13}$ | $1\times10^{14}$ | $1\times10^{15}$ |
| low humidity | C | C | C | C | C |
| High humidity | B | A | A | A | A |

From the above-mentioned results, it is apparent, if the image forming apparatus provided with the guiding member of the present invention, favorable visible images in which no disturbance occurs on toner image regardless of environmental conditions after image formation is repeated for numerous times are formed.

To the contrary, the comparative samples provide poor slidability under low humidity. Due to friction charge, those comparative samples having high surface resistance values provide black streak. On the other hand, under high humidity, those comparative samples having low surface resistance value is caused to leak the charge so that white streak occurs. As a result, no comparative sample having surface resistance value capable of providing favorable image could not be obtained.

The material of recording sheet guiding member of the present invention is a conductive resin composed of a resin in which a conductive agent and a bromine-containing organic compound are contained. Therefore, in terms of physical properties, aforesaid recording sheet guiding member is difficult to be subjected to friction charging even when it is oscillated with the recording sheet conveyed. Moreover, even if it is subjected to friction charging, the degree is so low that the charged potential does not increased to a high status locally.

Therefore, when aforesaid recording sheet is conveyed in such a manner that the rear surface of the recording sheet which electro-statically retains un-fixed toner image is oscillated by aforesaid guiding member, aforesaid recording sheet guiding member does not become the cause for creating disturbance to aforesaid toner image. Aforesaid effect can be provided surely regardless of the environmental conditions. In addition, durability can be obtained.

There is no limit to the kind of resin which constitutes the main portion of the conductive resin forming aforesaid recording sheet guiding member. Therefore, inexpensive resin can be used. In addition, with regard to the manufacturing method, it is so simple that a conductive agent and a bromine-containing organic compound may be incorporated in a resin. Therefore, it can be manufactured by a method of simply kneading. Accordingly, manufacturing is easy and cost is inexpensive.

What is claimed is:

1. A sheet guiding member for guiding a sheet having a toner image on its surface, comprising:

the sheet guiding member formed by a conductive resin material such that the sheet guiding member has a surface resistance value of $1\times10^{8}$ Ω·cm to $1\times10^{13}$ Ω·cm, wherein the conductive resin material comprises a resin, a conductive material and a bromine-containing organic compound.

2. The sheet guiding member of claim 1, wherein the conductive resin comprises 100 weight parts of the resin, 0.1 to 10 weight parts of conductive agents composed of carbon black as the conductive material and 0.1 to 30 weight parts of the bromine-containing organic compound.

3. The sheet guiding member of claim 2, wherein the conductive resin comprises 0.5 to 10 weight parts of the bromine-containing organic compound.

4. The sheet guiding member of claim 3, wherein the conductive resin comprises 1.0 to 5.0 weight parts of the bromine-containing organic compound.

5. The sheet guiding member of claim 1, wherein the bromine-containing organic compound is at least one selected from a group consisting of a brominated phosphate type compound, a brominated bisphenol type compound, a bis(brominated phenyl)alkane type compound and a brominated cyanurate-containing compound.

6. The sheet guiding member of claim 5, wherein the bromine-containing organic compound is the brominated phosphate type compound.

7. The guiding member of claim 1, wherein the conductive resin is produced by mixing the resin, the conductive material and the bromine-containing organic compound and by kneading the mixture.

8. The sheet guiding member of claim 1, wherein the conductive resin further comprises an antimony trioxide.

9. The sheet guiding member of claim 8, wherein the conductive resin comprises 0.1 to 30 wt parts of the antimony trioxide on 100 wt parts of the resin.

10. The sheet guiding member of claim 1, wherein the sheet guiding member has a surface resistance value of $1\times10^{9}$–$1\times10^{12}$ Ω·cm.

11. An image forming apparatus, comprising:

a photoreceptor on which a toner image is formed;

a transfer device for transferring the toner image from the photoreceptor onto a sheet; and a sheet guiding member for guiding the sheet having the transferred toner image, the sheet guiding member formed by a conductive resin material such that the sheet guiding member has a surface resistance value of $1\times10^{8}$ Ω·cm to $1\times10^{13}$ Ω·cm, wherein the conductive resin material comprises a resin, a conductive material and a bromine-containing organic compound.

12. The image forming apparatus of claim 11, further comprising:

a fixing device for fixing the toner image on the sheet, wherein the sheet guiding member is provided between the transfer device and the fixing device.

13. The image forming apparatus of claim 11, wherein the conductive resin comprises 100 weight parts of the resin, 0.1 to 10 weight parts of conductive agents composed of carbon black as the conductive material and 0.1 to 30 weight parts of the bromine-containing organic compound.

* * * * *